US005422164A

United States Patent [19]

Stanton

[11] Patent Number: 5,422,164

[45] Date of Patent: Jun. 6, 1995

[54] SHALLOW ARCH COVER FOR FIGHTING POSITION

[75] Inventor: Terry R. Stanton, Vicksburg, Miss.

[73] Assignee: The United States of America as represented by the Secretary of the Army, Washington, D.C.

[21] Appl. No.: 123,122

[22] Filed: Sep. 17, 1993

[51] Int. Cl.[6] ..... B32B 3/28; F41H 5/02

[52] U.S. Cl. ..... 428/182; 428/212; 428/911; 89/36.02; 37/466

[58] Field of Search ..... 428/172, 174, 182, 184, 428/212, 99, 68, 192, 911; 89/36.02; 52/3, 4, 88, 795; 405/141, 288; 2/2.5; 37/466

[56] References Cited

U.S. PATENT DOCUMENTS

| | | | |
|---|---|---|---|
| 2,455,237 | 11/1948 | Davies | 52/3 |
| 2,460,662 | 1/1949 | Van Voorhis | 52/88 |
| 3,832,265 | 8/1974 | Denommee | 161/404 |
| 3,974,313 | 8/1976 | James | 428/176 |
| 4,426,429 | 1/1984 | Di Russo et al. | 428/654 |
| 4,879,154 | 11/1989 | Bennett et al. | 428/81 |

*Primary Examiner*—Donald J. Loney
*Attorney, Agent, or Firm*—Luther A. Marsh

[57] ABSTRACT

An overhead foxhole cover takes the form of a shallow arch. The shallow arch is fabricated from a light weight material and is provided with corrugations running parallel to the plane in which the arch is formed in the cover. The arch is preferably formed in 12 gauge aluminum and is capable of withstanding the blast from an 82 mm mortar. The arch is used by first digging a two-soldier fighting position; placing retaining walls, if needed; placing the cover over the center of the fighting position; placing the bags over the cover to retail a soil cover; and placing 18 inches of soil cover over the sandbagging shallow arch.

11 Claims, 1 Drawing Sheet

SHALLOW ARCH COVER FOR FIGHTING POSITION

The present invention pertains to a method and apparatus for providing a fighting position and more particularly to a shallow arch cover for such a fighting position.

BACKGROUND OF THE INVENTION

The basic mission of the combat soldier is to take and hold ground. Light infantry troops generally use foxholes for this purpose. U.S. Pat. No. 4,879,154 to Bennett discloses a reinforced utility mat which is capable of being used as an overhead cover for fighting troops using a foxhole. The aforementioned patent discusses a number of problems inherent in the use of foxholes and in the prior art methods of providing overhead foxhole cover. In addition to the problems discussed therein, incorporated by reference in the present specification, the mat presented in the Bennett patent is deficient in providing a foxhole cover which will allow soldiers to effectively use their weapons, since the mat lays directly on the foxhole, flush with the ground level which forms the top surface of the foxhole. Further, such fabric roll type covers are subject to collapse under heavy loads.

Additionally cover may be provided by construction materials, which are heavy, bulky, require a great deal of labor to use, and present problems in shipping, transportation, storage, and distribution.

SUMMARY OF THE INVENTION

With the foregoing background in mind, it is a primary objective of the present invention to provide a foxhole cover which will offer protection to the fighting soldier while allowing the soldier to continue fighting effectively.

It is an additional object of the invention to provide a foxhole overhead cover which is capable of withstanding mortar fire and fire from other small arms.

It is also an object of the present invention to provide a foxhole overhead cover which is light in weight.

It is in additional object of the present invention to provide an overhead cover capable of withstanding dead load of al least 18 inches of soil.

A further object of the invention is the provision of such an overhead cover which is recoverable for future use.

Another object of the invention is the provision of such an overhead cover which is adapted to be stacked or nested for easy transportation and storage.

It is an additional object of the invention to provide a foxhole overhead cover which is of one-piece construction, and is thus ready to use and easy to fabricate.

It is also object of the present invention to provide a foxhole overhead cover which is operable under any climactic conditions.

It is an additional object of the present invention to provide an overhead cover which is waterproof.

The above and other objects of the invention which will become apparent hereinafter are achieved by the provision of an overhead foxhole cover which takes the form of a shallow arch. The shallow arch is fabricated from a light weight material and is provided with corrugations running parallel to the plane in which the arch is formed in the cover. The arch is preferably formed of 12 gauge aluminum and is capable of withstanding the blast from an 82 mm mortar. The arch is used by first digging a two-soldier fighting position; placing retaining walls, if needed; placing the cover over the center of the fighting position; placing said bags over the cover to retail a soil cover; and placing 18 inches of soil cover over the sandbagged shallow arch.

For a more complete understanding of the invention and the objects and advantages thereof, reference should be had to the accompanying drawings and the following detailed description wherein preferred embodiments of the invention are illustrated and described.

DETAILED DESCRIPTION OF THE PREFERRED EMBODIMENTS

Figure 1:
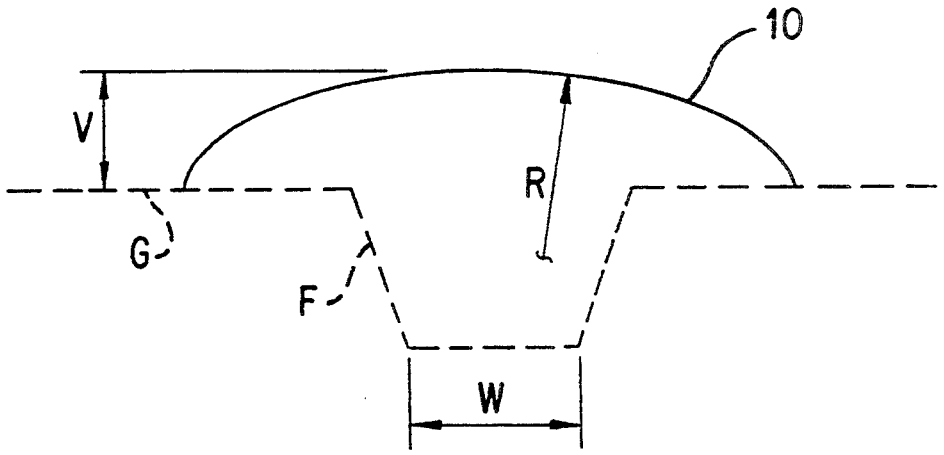
FIG. 1 is a schematic elevational view of the preferred embodiment of the overhead cover of the present invention, showing the cover in place over a fighting position.
Figure 2:
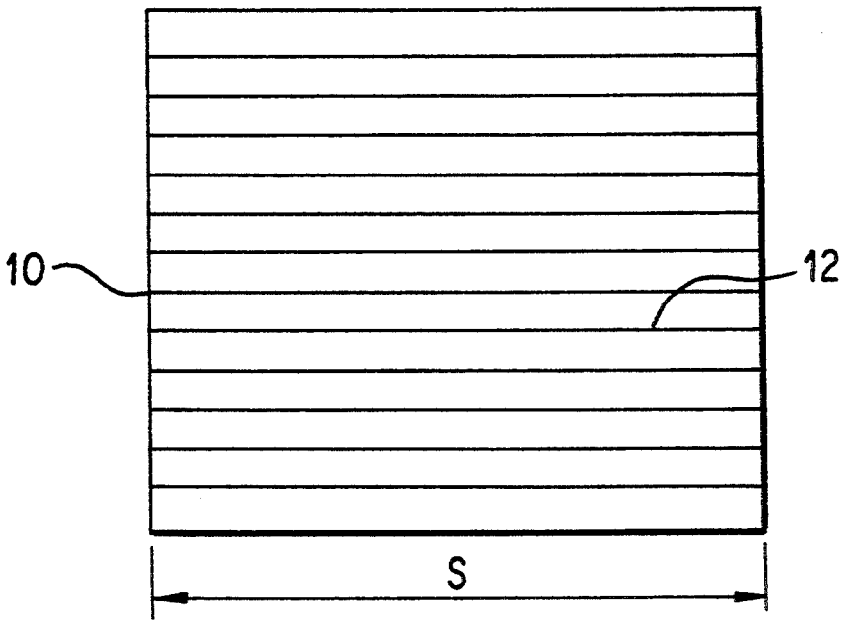
FIG. 2 is a plan view of the preferred embodiment of the overhead shallow arch cover of the present invention, showing the corrugations in the cover.

With reference to FIGS. 1 and 2, an overhead fighting position cover in accordance with the invention, designated generally by the reference numeral 10, is illustrated.

Overhead fighting position cover 10 takes the form of a shallow arch provided with a plurality of corrugations 12 running parallel to the plane in which the arch is formed. Arch 10 has a span S which is sufficient to cover a two-person fighting position, or foxhole F which has been dug in the ground G. In the preferred, illustrated embodiment, the foxhole F has a width W at its base of 2 feet, and the cover 10 has a span S of 5, a vertical height above ground G of 12 to 18 inches, a radius R of about 3.7 feet, and a length (the direction orthogonal to the span,) of 4 feet. The cover is preferably made of 12 gauge aluminum.

In explosive tests the cover proved capable of withstanding a blast of an 82 mm mortar.

Features of the inventive shallow arch cover include: light weight; capability of withstanding dead load of at least 18 inches of soil; recoverability for future use; nestable, i.e., stackable for easy transportation and storage; ready for use; one-piece construction; allows use of weapons; useful in any climactic conditions; waterproof.

In operation, i.e., in field use during combat, the cover 10 is deployed as follows. First a two-person fighting position is dug. Next retaining walls are put into place if required. The cover 10 is then placed over the fighting position, and checked to insure that firing parts and lanes are not obscured.

Next, sand bags are placed over the cover to allow for retention of a soil cover. Finally, an 18 inch soil cover is placed over the sandbagged shallow arch cover 10. It is clear that a single soldier can construct a fighting position with cover according the inventive method and apparatus.

In an alternative preferred embodiment, individual covers may be bolted together to form larger positions or shelters.

Thus, while preferred embodiments of the invention have been illustrated and described in detail herein, it will be apparent that changes and additions may be had therein and thereto without departing from the spirit of the invention. Reference should, accordingly, be had to be appended claims in determining the true scope of the invention.

What is claimed is:

1. An overhead cover for providing mortar and small arms fire protection for the individual soldier, comprising:

a shallow arch fabricated from a light weight material;

the shallow arch having corrugations running parallel to a plane in which the shallow arch is formed in the overhead cover;

the shallow arch, when covered with at least about 18 inches of soil, providing mortar and small arms fire protection.

2. The overhead cover of claim 1 wherein the shallow arch has a height in a range of about 12"to 18".

3. The overhead cover of claim 1 wherein the shallow arch has a span of about 5'.

4. The overhead cover of claim 1 wherein the shallow arch describes a radius of about 3.7'.

5. The overhead cover of claim 3 wherein the shallow arch has a length of about 4'.

6. The overhead cover of claim 1 wherein the shallow arch is capable of withstanding the blast of an 82 mm mortar.

7. The overhead cover of claim 3 wherein the shallow arch cover is adapted to nest with another of said shallow arch covers.

8. The overhead cover of claim 1, wherein the shall arch is recoverable for future use.

9. A method of constructing a fighting position comprising:

digging a two-person fighting position in the ground;

placing a shallow arch cover over a center of the position;

checking the placement of said shallow arch cover to insure that firing parts and firing lanes are not obscured;

placing sand bags over said cover to provide a retention for a soil cover; and placing an 18 inch soil cover over said sand bagged arch.

10. The method of claim 9 further comprising the step of placing retaining walls around the fighting position.

11. The method of claim 10 further comprising bolting a plurality of shallow arch covers together to provide a multi-unit shelter.

* * * * *